US005222472A

United States Patent [19]

Landingham

[11] Patent Number: 5,222,472

[45] Date of Patent: Jun. 29, 1993

[54] MULTIPLE-SHOT RUBBER GUN WITH PRELOADED CYLINDERS

[76] Inventor: Elmer L. Landingham, 1980 Hughes Way, Juneau, Ak. 99821

[21] Appl. No.: 644,108

[22] Filed: Jan. 22, 1991

[51] Int. Cl.[5] ..... F41B 7/02

[52] U.S. Cl. ..... 124/19; 124/48

[58] Field of Search ..... 124/18, 19, 35.1, 41.1, 124/48, 17

[56] References Cited

U.S. PATENT DOCUMENTS

| | | | |
|---|---|---|---|
| 3,515,387 | 6/1970 | House | 124/19 X |
| 3,693,609 | 9/1972 | Vodinh | 124/19 |
| 3,757,760 | 9/1973 | Darnell | 124/19 |
| 4,676,219 | 6/1987 | Miller | 124/19 |
| 4,800,864 | 1/1989 | Small | 124/19 |

*Primary Examiner*—Randolph A. Reese
*Assistant Examiner*—John Ricci

[57] ABSTRACT

A toy gun for repeatedly firing stretched rubber bands from projections upon removable rotating hollow cylinders. All mechanisms are themselves powered by rubber bands. While unattached to the gun, cylinders are wound up by separating a front locking pin and turning front and body in opposite directions, thus winding the rubber band affixed inside. Inserting the cylinder onto the gun frame forces the cylinder to contact a projection which again separates the front locking pin from the cylinder body. The cylinder has on its exterior raised lengthwise projections, called "slats". Each slat but one has near the rearward end of the gun a notch. A cylinder is loaded by stretching a rubber band over each notched slat. Aligned with slat notches is a holding pin affixed to the gun. The holding pin contact either a rubber band or the unnotched slat, preventing unwanted cylinder rotation. Pulling the trigger engages a 'slip hammer' that pushes the rearward part of the rubber band above the slat. The rubber band fires, thus freeing the cylinder, powered by the cylinder's internal rubber band, to rotate to the next position as the slat's notch, now freed of its rubber band, turns past the holding pin. Other rubber bands re-cock the trigger, making the gun ready to fire again. A cylinder exhausted of rubber bands comes to a stop when the unnotched slat contacts the holding pin. An exhausted cylinder can be repidly replaced with a loaded one, permitting extended firing.

2 Claims, 1 Drawing Sheet

MULTIPLE-SHOT RUBBER GUN WITH PRELOADED CYLINDERS

BACKGROUND OF THE INVENTION

This is an application to patent a new way of dispensing rubber bands from a hand-held stock allowing the user to dispense multiple rubber bands quickly. It has a hand-held stock, and quick changeable cylinders, each holding six to ten or more slats depending on desire. Thus, it could be called a rubber band gun that can be quickly reloaded.

There is nothing (to my knowledge) on the market or patented like this design. Each gun would have one or more cylinders that can be preloaded (rubber bands stretched over slats) and can be quickly fitted to a hand-held stock.

Six models have been built and have been operating—from a 3-inch cylinder to a 10-inch cylinder—each dispensing a different size rubber band. The cylinder can be exposed on top of the stock as the draqwing shows, or enclosed inside a stock and shot through a hollow tube, as a rifle or large pistol configuration. All prototype models are built from hardwoods—but the design could easily be carried over to millable or castable plastics or space-age nylons and sold very cheaply. I have used rubber bands that have little chance of causing injury to users, especially children. For example, a 6-inch barrel with #30 rubber bands—this size can easily spin light free-spinning targets with an accuracy of about 15 feet. A gun can be made to shoot any size rubber band, and a variety of rubber band sizes can be loaded on the same cylinder.

The invention relates in principal to toy guns with rotating cylinders with the capability of firing multiple shots fast and accurately with the pull of a trigger mechanism. A number and variety of rubber band repeating guns for rapidly discharging rubber bands have been proposed. U.S. Pat. Nos. 3,757,760, 3,693,609, and 4,800,864 are generally indicative of the state-of-the-art.

All of these proposals mentioned above have the ability to discharge rubber bands in a repeating fashion. They all use a rotating barrel to accomplish both the release of a rubber band and rotation of the barrel to the next firing position, by means of a cam, or a rod, or trip levers to push the rubber band off stationary or pivotal catches. Each pull of the trigger mechanism rotates the cylinder, releasing a rubber band, and the release of the trigger advances the barrel to the next firing position.

The first two patents mentioned above (U.S. Pat. Nos. 3,757,760 and 3,693,609) distort the alignment of the rubber band and impair the shooting accuracy. The last mentioned patent (U.S. Pat. No. 4,800,864) firmly stops the barrel against an acuator stop as it is fired, by a series of pivot hooks disposed on the rear end of a stretched rubber band, the forward end of which is retained by a correcponding hook disposed on the front of the cylinder. All of the above are much more complicated to manufacture than necessary to accomplish precise barrel alignment and cylinder rotation. It is also much more complicated to manufacture than necessary and difficult to hand build in a manner commensurate with fine craftmanship, attractive to adults as well as to children. All other prior art makes it difficult to produce an attractive, aesthetically pleasing toy.

SUMMARY OF THE INVENTION

Accordingly it is an object of the invention to provide a simpler type of toy gun for discharging rubber bands than has been previously patented, with the added capability of quickly reloading the toy gun with preloaded cylinders, allowing nearly continuous shooting as long as a new preloaded cylinder is available. Any number of cylinders can be made for each toy rubber gun. This new toy gun allows the user to shoot rubber bands as fast as he or she can pull the trigger. This gun is an improvement over prior art rubber band shooting guns, by eliminating all complicated moving parts, and requires less accuracy in its manufacture while allowing the cylinder to index top dead center on each rotation and to be held there until the trigger is released, with no levers, complicated cams or trip mechanisms that are needed in all previous toy rubber band guns. It also has the advantage over any prior art rubber band shooting guns of using preloaded cylinders which can be quickly and easily loaded for continuous shooting of rubber bands. A user can have as many preloaded cylinders as he wants. These cylinders are easier to load than the cylinders of all other prior art guns, because they are out of the holding frame and do not depend on any mechanical device being in a particular position while loading.

BRIEF DESCRIPTION OF THE DRAWINGS

FIG. 2 also shows configuration of trigger and slip hammer and rubber bands that work the mechanism.

DETAILED DESCRIPTION OF THE PREFERRED EMBODIMENT

Figure 1:
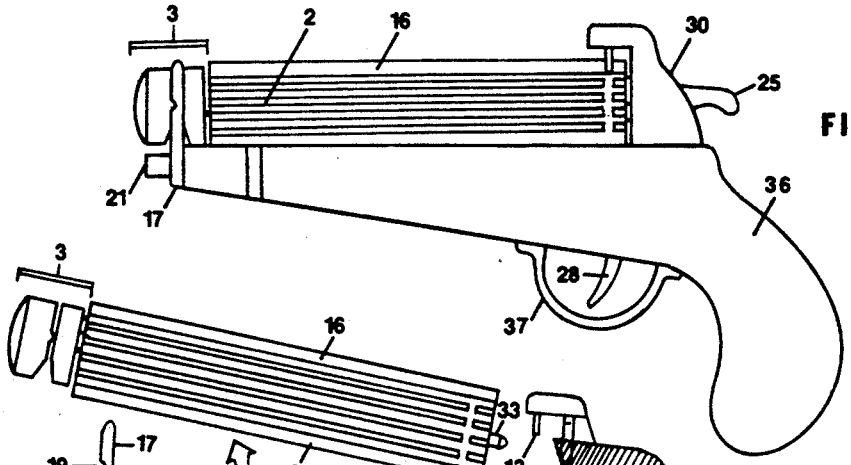
FIG. 1 is a side profile view of my repeating rubber band gun, unloaded.

Referring now to the drawings, toy rubber gun includes laminated stock 30, 35, and 36 in a frame, 24, with attached front plate, 17, side plate, 32, with trigger, 28, slip-hammer, 25, stationary dowel cam, 26, tension rubbers 29 and 27, cylinder stop pin, 13, cylinder, 1*a*, with wound-up rubber band, 1, front locking mechanism, 3.

Figure 3:
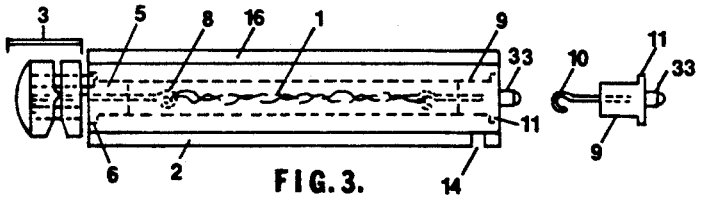
FIG. 3 is a cross section of cylinder construction, lock mechanism in lock position, and tail bearing in place.

A wound-up rubber band, 1, turns a cylinder, 1*a*, best shown in FIG. 3.

Figure 2:
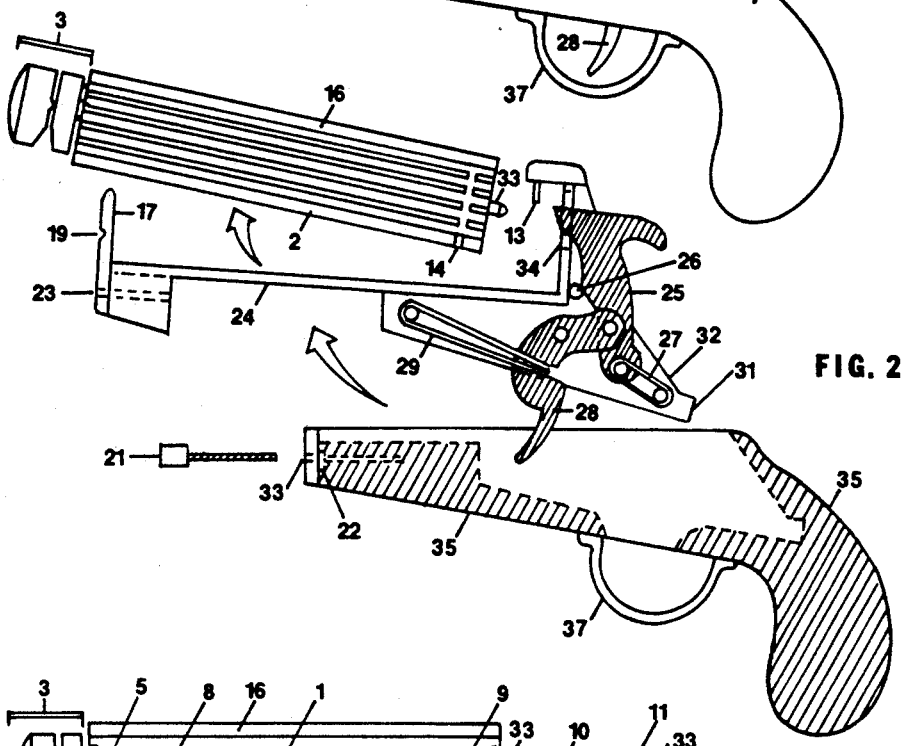
FIG. 2 is a side cross-section view showing how toy gun, FIG. 1, separates from removeable parts; cylinder from holding frame, holding frame from stock.

Several slats, 2, six or more, on a cylinder that holds rubber bands to be released, best seen in FIG. 2.

Front locking mechamism, 3, to prevent rubber band in cylinder from turning while the cylinder is out of the holding frame, 24, shown locked in FIG. 3, unlocked in FIG. 1.

Figure 6:
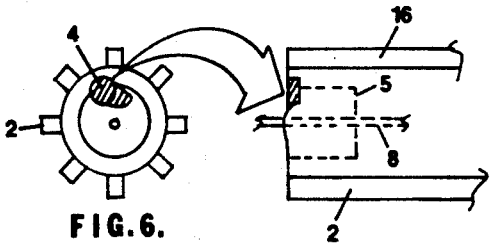
FIG. 6 is a front view of cylinder showing sloped ramp and drilled hole in front of cylinder, shown with eight slats.

Drilled hole in front of cylinder with sloped entrance, 4, to assure device locks cylinder as it is removed from the holding frame, best shown in FIG. 6.

Figure 5:
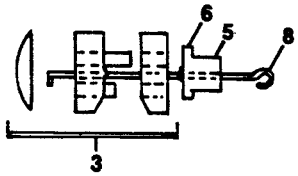
FIG. 5 is a side cross-section of front locking mechanism.

Front cylinder bearing, 5, for wire shaft, 8, best shown in FIG. 5.

Locking dowel, 6, for front cylinder bearing, 5, to keep bearing from turning in cylinder as best seen in FIG. 3.

Corresponding slot, 7, in cylinder for locking dowel, 6, as best shown in FIG. 3.

Piano wire shaft, 8, passing through cylinder bearing, 5, with hook end secured on front locking mechanism, 3, by embedding and bending wire 90 degrees, best shown in FIG. 5.

Stationary end bearing, 9, best shown in FIG. 3.

Stationary end bearing piano wire with hook embedded in bearing, 9, so piano wire hook won't turn, best shown in FIG. 3.

Dowel, 11, through end bearing, 9, that keeps bearing from turning, best shown in FIG. 3.

Slot, 11, for end bearing dowel in cylinder, best shown in FIG. 3.

Cylinder stop pin, 13, that prevents cylinder from turning when slat is loaded, best shown in FIG. 1.

Cut-out, 14, in each slat that holds a rubber band that allows stop pin to pass through, best shown in FIG. 2.

Figure 4:
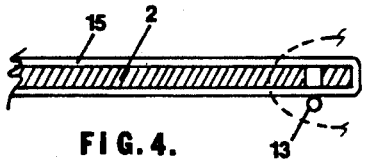
FIG. 4 is an expanded top view of one slat loaded, showing how rubber band prevents stop pin from passing through slot.

Rubber band on slats keeping the cylinder from turning until after the rubber band is released, best shown in FIG. 4.

One slat is not cut out, 16, which keeps cylinder from turning after all rubber bands have been released, thus keeping the remaining stored energy in the cylinder's wound-up rubber band, 1, best shown in FIG. 3.

Figure 7:
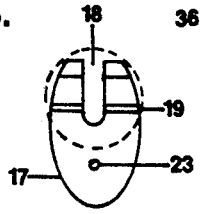
FIG. 7 is a front view of front plate and details.

Front frame plate that locking mechanism fits onto, best shown in FIG. 7.

Front frame plate notched, 19, to keep locking mechanism from coming off; front frame plate opens the locking mechanism to release the cylinder, best shown in FIG. 1.

Front frame plate slotted, 18, to accept locking mechanism, 3, best shown in FIG. 7.

A taper is on each half of front locking mechanism, 3, to make it easy to place on front frame plate, 17, best shown in FIG. 2.

Bolt embedded in dowel, 21, to keep frame, 24, in laminated stock, 30, 35, and 36, best shown in FIG. 2.

Nut, 22, embedded in stock, 35, that accepts bolt, 21, best shown in FIG. 2.

Hole in front plate, 23, to accept bolt, 21, best shown in FIG. 7.

Holding frame, 24, with attached side-plate, 32, houses trigger, 28, and slip-hammer, 25, best shown in FIG. 2.

Dowel cam, 26, prevents hammer from contacting cylinder slat when trigger, 28, is forward, best shown in FIG. 2.

Tension rubber band, 27, to keep constant pressure on slip-hammer, 25, on cylinder slats, 2, and on unnotched slat, 16, best shown in FIG. 2.

Rubber band, 29, for returning trigger to forward position, best shown in FIG. 2.

Figure 8:
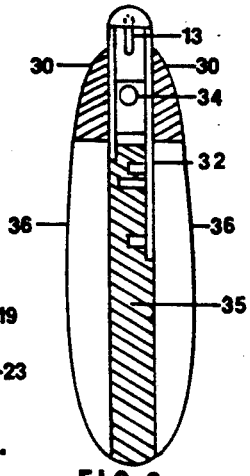
FIG. 8 is an end view cross-section of assembled frame and stock showing three-part lamination.

Section of stock, 30, comes off with holding frame, 24, best shown in FIG. 2 and FIG. 8.

Projecting end of side plate, 31, fits in stock, 35, to secure holding frame, 24, and side plate, 32, best shown in FIG. 2.

Male part of tail-bearing, 33, on end of cylinder, 1*a*, to allow cylinder to rotate, and corresponding female side of tail bearing, 34, in holding frame, 24, to accept male tail bearing, 33, best shown in FIG. 2.

Center of three-piece glued laminated stock, 35, is cut out to allow holding frame, 24, and side-plate, 32, to fit into stock, best shown in FIG. 2.

Outer sections, 36, of three-piece laminated stock to complete stock shape, best shown in FIG. 8.

Trigger guard, 37, attached to center of stock, 35, best shown in FIG. 2.

I claim:

1. A toy gun for repeatedly, rapidly firing a plurality of stretched rubber bands, comprising in combination:

a. a removable and reloadable hollow rotary cylinder, containing on the inside a rubber band fixed to a rearward end and affixed also to a rotatable front end, which inside rubber band, when wound up by turning the front end, provides force to rotate the cylinder, and also provides force to bias the front end toward the rear end; pin means to prevent the front end from turning relative to the cylinder when the cylinder is removed from the gun; affixed to the outside surface of the cylinder a plurality of lengthwise raised projections or 'slats', all but one of which slats is notched near the rear end of the cylinder, and over which slats rubber bands are stretched prior to (or after) placing the cylinder in the gun;

b. a gun hand-holdable stock, with a front separator device which, when a cylinder is loaded into the gun, separates the front end of the cylinder from the rest of the cylinder, thereby disabling the pin means and allowing the cylinder to rotate relative to the front end;

c. a cylinder stop pin on the stock, aligned so as to slip through the notches in slats, which pin descends from above the rearward end of the cylinder to rest against either a stretched rubber band or against the unnotched slat to prevent the rubber-band powered cylinder from rotating except after a stretched rubber band is fired, and only when permitting the cylinder to rotate its notched slat past the holding pin until contacting the next stretched rubber band or final unnotched slat;

d. a trigger that uses spring means for cocking and firing tension;

e. a spring-powered slip hammer, held tightly against the rear of the rotating cylinder, which hammer pushes the stretched rubber bands off the top-most slat on the cylinder when the trigger is activated;

f. a dowel cam under the slip hammer;

all of which, acting in combination, permit both (1) the rapid firing of stretched rubber bands from any one cylinder as fast as the trigger can be pulled and released and (2) the rapid replacement of empty cylinders with loaded rotary cylinders to permit firing with only brief interruptions for reloading.

2. A method of operating a toy gun to shoot a plurality of stretched rubber bands from removable rotating cylinders, comprising the steps of:

a. loading a plurality of rubber bands on elongated raised projections on the surface of a cylinder—hereafter termed 'slats'—all of which slats but one are notched near the rearward end of the cylinder, by stretching each rubber band into an elongated configuration with each end slipped over slats on the rounded surface of the cylinder, such slats extending from one end of the cylinder nearly to the other;

b. affixing a rubber band within the cylinder between a rear end and a front locking mechanism; winding the rubber band within the cylinder, by turning the front locking mechanism of the cylinder in one direction and by turning the body of the cylinder in the other direction, thereby causing the cylinder to be rotatably biased relative to the front mechanism, and the front mechanism to be biased toward the rear end;

c. preventing the unwinding of the internal rubber band of the cylinder by inserting a dowel rod on the front mechanism of the cylinder into a sloped entrance or socket on the cylinder itself;

d. inserting the loaded, wound-up cylinder into the frame of the gun in such a manner that the cylinder's front locking mechanism are separated from the cylinder by a front plate of the gun's frame;

e. preventing the rotation of the cylinder while in the gun by the engagement of a cylinder stop pin, located on the gun frame above the top rear of the placed rotary cylinder and aligned with the cylinder's slats notches, which pin engages either a stretched rubber band or the un-notched slat;

f. pulling a trigger;

g. moving slip hammer, held closely to the rear of the rotating cylinder by rubber bands, in response to pulling the trigger, so that the slip hammer pushes upward on the rearward part of a stretched rubber band;

h. firing the rubber band forward by raising the rearward part of the rubber band above the top of the slat by means of the slip hammer;

i. permitting the powered cylinder to rotate, as the cylinder stop pin on the gun frame, no longer retained by the now-discharged rubber band, slips through the notch in the slat, with the cylinder continuing to rotate until stopped by the contact of the cylinder stop pin with either the next stretched rubber band or with the unnotched slat;

j. using other rubber bands, internal to the trigger mechanism, to re-cock the trigger, so that the gun may be fired as rapidly as the trigger is pulled, until the cylinder's supply of stretched rubber bands is exhausted; and k. permitting the rapid reloading and continued firing of rubber bands by means of removing the exhausted cylinder and by replacing it with another cylinder already loaded with stretched rubber bands and already powered by an internally wound rubber band, which cylinder is prevented from rotating when not in the holding frame by a front locking mechanism.

* * * * *